US005676124A

United States Patent [19]

Lee

[11] Patent Number: 5,676,124

[45] Date of Patent: Oct. 14, 1997

[54] CERAMIC AND MASONRY POWER SAW

[75] Inventor: Wy Peron Lee, Riverside, Calif.

[73] Assignee: K Diamond Inc., Ontario, Calif.

[21] Appl. No.: 585,359

[22] Filed: Jan. 11, 1996

[51] Int. Cl.[6] ..... B28D 1/04

[52] U.S. Cl. ..... 125/13.01; 451/307; 451/342; 451/363; 125/13.03

[58] Field of Search ..... 125/13.01, 13.03, 125/11.22; 451/360, 361, 362, 363, 449, 453, 356, 272, 212, 342, 450, 488; 83/167, 490, 437

[56] References Cited

U.S. PATENT DOCUMENTS

| | | | |
|---|---|---|---|
| 1,669,941 | 3/1928 | Kennedy . | |
| 1,862,583 | 7/1932 | Skriba . | |
| 2,160,777 | 5/1939 | Dall et al. . | |
| 2,337,718 | 12/1943 | Hoppes . | |
| 2,455,113 | 11/1948 | Coates | 125/13.03 |
| 2,514,826 | 7/1950 | Zuzelo | 125/13.03 |
| 2,562,578 | 7/1951 | Rickman | 451/363 |
| 2,675,653 | 4/1954 | Bryant | 451/342 |
| 2,726,651 | 12/1955 | Tucker | 125/13.03 |
| 2,863,441 | 12/1958 | Harclerode | 125/13.01 |
| 2,998,813 | 9/1961 | Wilson | 125/13.03 |
| 3,634,975 | 1/1972 | Hensley . | |
| 4,393,626 | 7/1983 | Schroer . | |
| 4,468,895 | 9/1984 | Signorelli | 451/342 |
| 4,730,952 | 3/1988 | Wiley . | |
| 4,787,147 | 11/1988 | Wiley . | |
| 4,829,718 | 5/1989 | Behm | 451/342 |
| 5,084,972 | 2/1992 | Waugh . | |
| 5,127,391 | 7/1992 | O'Keefe . | |
| 5,529,531 | 6/1996 | Kaiser, Jr. et al. | 451/307 |

FOREIGN PATENT DOCUMENTS

| | | | |
|---|---|---|---|
| 299552 | 11/1928 | United Kingdom | 451/342 |

OTHER PUBLICATIONS

Mechanical Engineering Design by Joseph Edward Shigley 1977.

*Primary Examiner*—Robert A. Rose
*Assistant Examiner*—George Nguyen
*Attorney, Agent, or Firm*—Oppenheimer Poms Smith

[57] ABSTRACT

A ceramic tile and masonry power saw is disclosed. The saw has an electric motor and drives the circular diamond saw through a drive belt positioned immediately adjacent to the saw to minimize bending moments and stress. A pivoting cutting table has pinch rollers on one side that clamp to the frame of the saw. When the cutting table is pivoted away, there is enough clearance for side removal of the tray used to catch coolant and sawdust, located underneath the cutting table. A bearing housing that supports the spinning shaft on which the saw blade is mounted has a tapered shape that fits into a tapered opening in the cutting head assembly, which assembly overlies the cutting table and positions the saw blade just above the table.

15 Claims, 4 Drawing Sheets

CERAMIC AND MASONRY POWER SAW

BACKGROUND OF THE INVENTION

1. Field of the Invention

The present invention relates to ceramic and masonry saws. More precisely, the present invention relates to a ceramic and masonry power saw having a side removable tray with a cutting head that positions the drive belt adjacent to the saw blade for improved accuracy and durability.

2. Prior Art and Related Information

Ceramic and masonry power saws are commonly used in the construction industry for shaping and cutting masonry tiles and the like, made from materials such as granite, marble, slate, ceramics, paver, and brick. The conventional masonry saw includes a cutting table supported on a floor standing frame, a cutting head overhanging the cutting table with a circular diamond saw blade that is powered by an electric motor. Liquid coolant such as water, circulated by a pump, is usually used to cool the saw and work piece and to flush away saw dust.

Several desirable features for a ceramic and masonry power saw include the following: achieve precise and accurate cuts; ease of replacement of the blade when it is worn; ease of emptying the tray positioned underneath the cutting table, which collects saw dust and coolant; quick positioning and realignment of the work piece for multiple cuts; etc.

One example of a masonry saw designed for rapid adjustment of the saw blade to various positions to permit complex cuts is disclosed in U.S. Pat. No. 5,127,391 to O'Keefe. O'Keefe discloses a marble and tile cutting apparatus and method wherein the apparatus comprises a support, a tray on the support moving between a cutting and a non-cutting position, a motor mounted on the support and rotary cutting blade driven by the motor to cut marble or tile material, wherein a motor support and the motor may be moved laterally on the table support between pre-selected cutting positions, and wherein the tray includes a plurality of generally longitudinally pre-selected cutting grooves so as to permit the cutting blade to cut the marble or tile material in a cutting position with the grooves of the tray matching the pre-selected positions of the transversely movable molding and cutting blade for each particular cutting position.

There are other important features to saws in general, such as an adjustable table in a circular saw as disclosed in U.S. Pat. No. 1,669,941 to R. M. Kennedy. Another feature is quick replacement of a circular saw blade. For example, U.S. Pat. No. 4,787,147 to Wiley discloses a quick change mechanism for diamond arbor circular saw blades and other spinning disk devices. U.S. Pat. No. 4,393,626 to Schroer discloses a tool holder for supporting thin rotary tools. In Schroer, the tool holder assembly includes a tapered spindle end received inside a tapered bore.

There is still a need for a ceramic and masonry power saw having a torque transmitting system that minimizes stresses on the cutting blade that affect the accuracy of the cut. There is also a need for a ceramic and masonry power saw that has a conveniently removable tray that, as a result of the operator removing the tray, does not cause cut misalignment of the work piece.

SUMMARY OF THE INVENTION

In view of the foregoing needs, it is an object of the present invention to provide a ceramic and masonry power saw that locates the torque transmitting drive system interconnecting the motor to the circular saw blade in such a manner as to minimize unwanted bending moments. It is another object of the present invention to provide a ceramic and masonry power saw having a tapered bearing housing supporting a shaft on which the drive blade rotates to minimize wear and to facilitate ease of replacement of the bearings therein. It is still yet another object of the present invention to permit easy removable of the saw dust and coolant tray from underneath the cutting table without affecting alignment of the work piece or cutting table relative to the saw blade. It is yet another object of the present invention to provide a ceramic and masonry power saw that has a tray that is removable from the same side as where the operator stands during cleaning and maintenance of the saw.

To accomplish the foregoing objects, the present invention provides a ceramic and masonry power saw comprising a frame having a tubular section, a table having a pair of oppositely disposed rollers pinching the tubular section of the frame, whereby the table pivots on the rollers against the tubular section, a cutting head having a distal end and a proximal end, wherein the distal end extends over the table and wherein the proximal end is attached to the frame, a tapered bearing housing disposed inside the distal end of the cutting head, a circular saw blade mounted on a shaft rotatably supported within the tapered bearing housing, a motor attached to the frame, a drive belt interconnecting the shaft to the motor, wherein the drive belt engages the shaft immediately adjacent to the circular saw blade, and a tray disposed beneath the table, whereby the cutting table pivots on a side and away from the tray on an opposite side to allow removal of the tray.

The present invention has many advantages over the prior art. First, positioning the drive belt immediately adjacent to the circular saw blade minimizes the bending moment on the saw blade thereby increasing the life of the rotating parts and improving accuracy of the cut. Second, the tapered bearing housing, due to its tapered shape, minimizes axial forces on the shaft on which the circular blade rotates, and simultaneously facilitates ease of disassembly for maintenance purposes without enlisting help from professionals. Third, in a preferred embodiment of the present invention, the cutting table pivots on the frame to provide clearance to remove the coolant tray from the side yet maintains constant contact with the frame to insure no need for realignment of the work piece under the cutting blade. Fourth, the side removable tray is very convenient as well because the operator stands along that same side of the power saw for cleaning and maintenance operations.

BRIEF DESCRIPTION OF THE DRAWINGS

The objects, features, and advantages of the present invention will be apparent to one skilled in the art from reading the following description in which.

DETAILED DESCRIPTION OF THE INVENTION

The following specification describes a ceramic and masonry power saw. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention.

Figure 1:
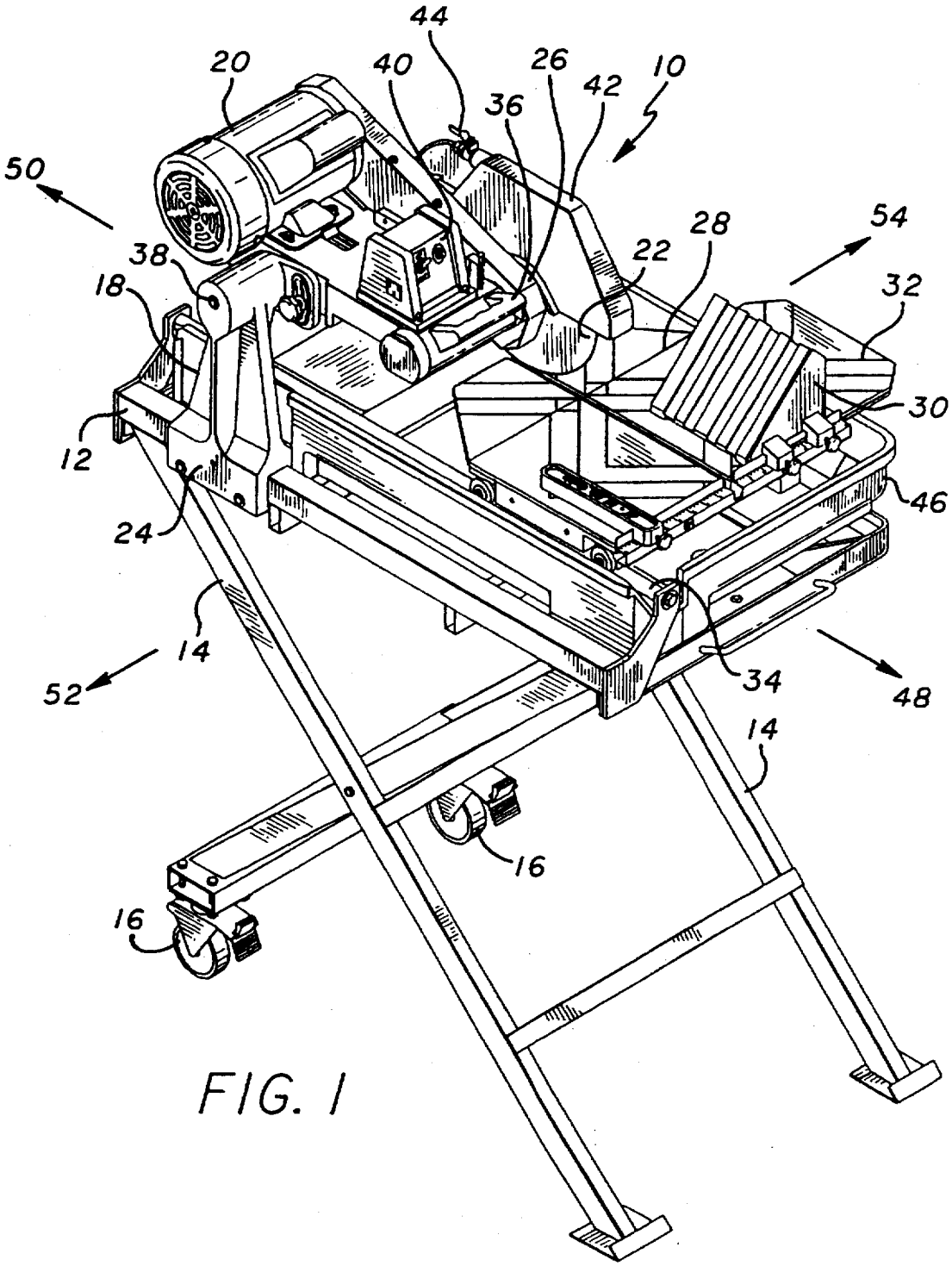
FIG. 1 is a perspective view of a preferred embodiment of the present invention ceramic and masonry power saw.

The present invention is directed to a ceramic and masonry power saw 10 shown in a perspective view in FIG. 1. In particular, the ceramic and masonry power saw of the present invention is designed to locate the belt drive system immediately adjacent to the cutting blade to minimize unwanted bending moments on the shaft on which the blade rotates. The present invention includes a tapered bearing housing that enhances the durability of the rotating parts connected to the circular saw blade and facilitates easy disassembly of those parts for maintenance. Also, the present invention includes a pivoting cutting table that quickly provides clearance for quick and easy removal of the coolant tray situated underneath the cutting table, without losing the accurate positioning of the table relative to the saw blade. In the preferred embodiment, the tray is removable laterally, which is convenient because the user stands on that same side of the saw for cleaning and maintenance operations.

In the preferred embodiment shown in FIG. 1, the ceramic and masonry power saw 10 includes a frame 12 having foldable support legs 14 thereunder. Optional rollers or wheels 16 provide a level of mobility. The wheels 16 are useful for moving the saw 10 around a construction site, for example.

Built around the frame 12 is a cutting head assembly 18 having a motor 20 mounted thereon and a circular saw blade 22. The circular saw blade 22 is preferably a diamond saw known in the art made for cutting tiles, ceramics, etc. The cutting head assembly 18 includes a proximal end 24 attached to the frame 12 and a distal end 26 to which the circular saw blade 22 is mounted. In order to facilitate the cut, the circular saw blade 22 is situated directly above a cutting table 28. On the cutting table 28 are a variety of work piece alignment fixtures 30 and jigs. Grooves 32 are optionally formed into the cutting table 28 to facilitate a variety of pattern cutting.

Importantly, the cutting table 28 is pivotably connected to a rolling bar 34 which forms part of the frame 12. In this manner, the cutting table 28 is directly connected to the cutting head assembly 18 which is connected to the circular saw blade 22; the direct connection of these parts provides a precise datum for more precise cutting of work pieces. Moreover, if the cutting blade 22 and the jigs holding the work piece are attached to a single structure, it is less likely that the parts will become misaligned. Consequently, tighter tolerances are achievable with the present invention.

A handle 36 is provided at the front of the cutting head assembly 18 to allow the operator to lift the circular saw blade 22 up and down, pivoting around shaft 38. A control panel 40 is situated near the handle 36 to control the electric motor 20.

The circular saw blade 22 includes an optional blade guard 42 to protect the operator from flying debris. An optional nozzle 44 is connected to the guard 42 to supply a stream of coolant to the saw blade 22. The coolant is pumped in from a reservoir (not shown). Beneath the cutting table 28 is a removable tray 46 to catch coolant flowing off of the cutting blade 22 and sludge formed from the coolant mixing with the saw dust.

In the preferred embodiment shown in FIG. 1, the ceramic and masonry power saw 10 includes a front, indicated by arrow 48, a back 50 and opposite sides 52, 54. Importantly, the cutting table 28 is pivotably connected to the rolling bar 34 of the frame 12 at side 52. Thus, when the cutting table 28 pivots up at side 54, the tray 46 can be removed at side 54. This is highly convenient to the operator for emptying out the tray 46 if it becomes filled with coolant. Other routine maintenance operations occur at this station too so there is no wasted movement for the operator. When the operator returns to cutting, he stands in front 48 of the saw 10.

Figure 2:
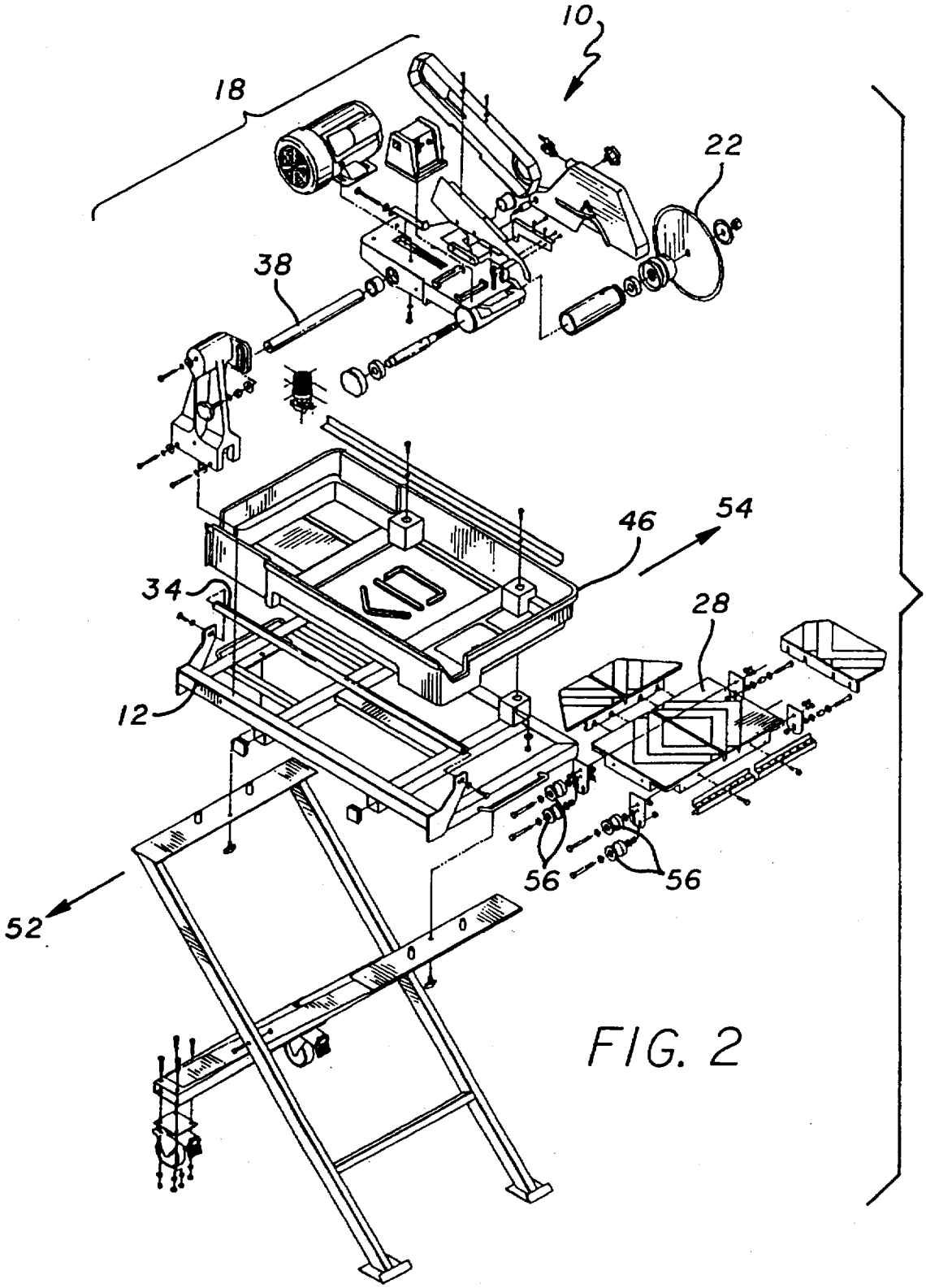
FIG. 2 is an exploded view of the preferred embodiment shown in FIG. 1.

FIG. 2 is a perspective exploded view of the present invention shown in FIG. 1. In this depiction, the removable tray 46 is fully exposed. Also, the rolling bar 34 part of the frame 12 is shown. In order to facilitate the pivoting action of the cutting table 28, the present invention optionally includes four rollers 56 that are positioned to engage the cylindrical shape rolling bar 34 on either side thereof. In fact, the rollers 56 pinch the rolling bar 34 to permit translation of the cutting table 28 axially or along the length of the rolling bar 34. Because each roller 56 has an outer circumference with a concave profile, the roller conforms to the curved circumference of the rolling bar 34. The rollers 56 thus do not permit lateral movement in the side to side directions 52, 54. The profile of the rollers 56 does, however, permit the cutting table 28 to pivot or rotate about the axis defined by the rolling bar 34 thereby allowing the edge of the cutting table 28 nearest side 54 to lift upward. This then creates room for the tray 46 to be removed by the operator. As mentioned earlier, the cutting head assembly 18 can be pivoted out of the way by rotating about shaft 38.

Importantly, despite the capability of the cutting table 28 to pivot and translate around rolling bar 34, the relative cutting alignments are maintained because the rolling bar 34 is directly connected to the frame 12, which is directly connected to the cutting head assembly 18, which holds the circular saw blade 22. Accordingly, the precise cutting alignment of the work piece mounted to the cutting table 28 relative to the circular saw blade 22 is not disturbed even though the cutting table 28 is shifted to allow removal of the tray 46.

Figure 3:
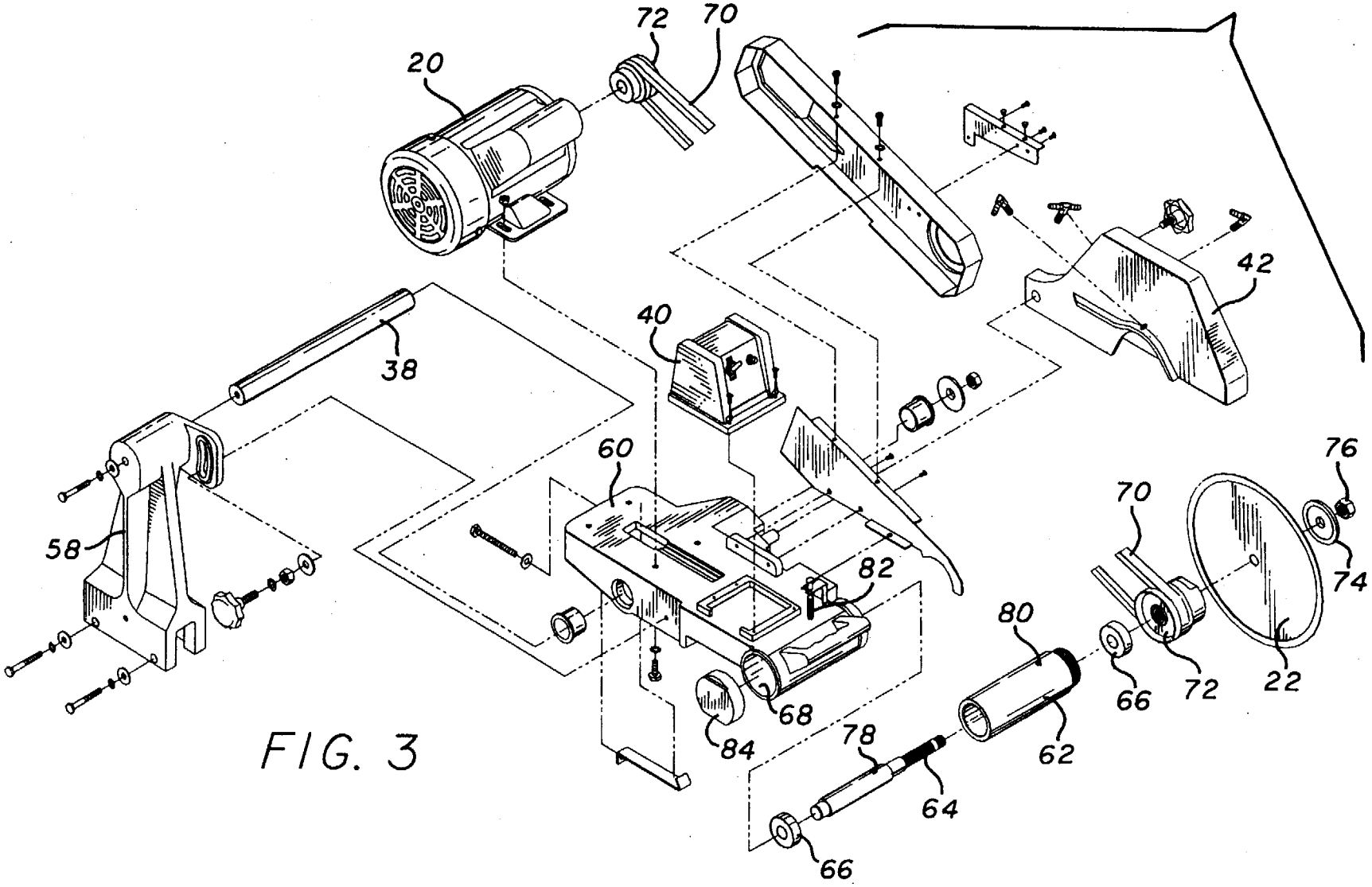
FIG. 3 is an exploded perspective view of a preferred embodiment cutting head assembly.

FIG. 3 provides an exploded view of the cutting head assembly 18. In the preferred embodiment, the cutting head assembly 18 comprises a support post 58 to which the cutting head 60 is pivoted through shaft 38. A control panel 40 controls a motor 20 and both are mounted on the cutting head 60. Toward the front of the cutting head 60 is a bearing housing 62 having a tapered shape and containing a blade shaft 64 therein. The blade shaft 64 is supported on either end by roller bearings 66. The tapered bearing housing 62 and the blade shaft 64 supported by bearings 66 are positioned inside the tapered opening 68 of the cutting head 60.

The circular saw blade 22 is mounted onto the blade shaft 64 and driven by a drive belt 70 rotating pulleys 72. An outer flange 74 and a lock nut 76 attach to a threaded end of the blade shaft 64 to keep the saw blade 22 thereon.

Advantageously, the present invention positions the drive belt 70 immediately adjacent to the circular saw blade 22. With this arrangement, the bending moment experienced by the blade shaft 64 due to the torque applied by the belt 70 is minimal. Furthermore, the bending moment caused by the drive belt 70 on the blade shaft 64 as it affects the cutting blade 22 is minimal because the moment arm defined by the distance between the drive belt 70 and the circular saw blade 22 is negligible. Hence, the present invention has a cutting head assembly 18 that can achieve very precise cuts. Not only is the cutting accuracy improved, the present invention also increases the operating life of the rotating parts because the bending moments created by the drive belt 70 on the blade shaft 64 and the associated bearings are minimized by its positioning immediately adjacent to the cutting blade 22.

The tapered bearing housing 62 has its larger diameter facing the cutting blade 22 and its smaller diameter at the opposite end. It is inserted into the tapered opening 68 which has a similar shape. In operation, any axial forces encountered by the rotating saw blade 22 is absorbed by the bearing housing 62. More importantly, disassembly of the bearing housing 62 for maintenance purposes is very convenient. In fact, the operator simply removes the lock nut 76, outer flange 74 to detach the saw blade 22 from the blade shaft 64, pulley 72, belt 70, and bearing housing cover 84. Despite the number of parts, with one hand, it is possible for the operator to withdraw the bearing housing 62 from inside the tapered opening 68 thereby withdrawing the bearing 66. In conventional devices, the bearings are open and have to be individually removed, requiring greater attention of the operator.

The present invention cutting head 60 is preferably made from aluminum. Inside the aluminum cutting head 60 is the bearing housing 62, which is preferably made from steel to ensure strength and durability.

In a preferred embodiment, the bearing housing 62 and blade shaft 64 have respective through holes 78, 80 formed radially therein. A radially biased locking pin 82 passing through the cutting head 60 reversibly engages the radial holes 78, 80 to immobilize the blade shaft 64. This feature is useful for when the circular saw blade 22 must be removed from the blade shaft 64 for maintenance purposes.

Figure 4:
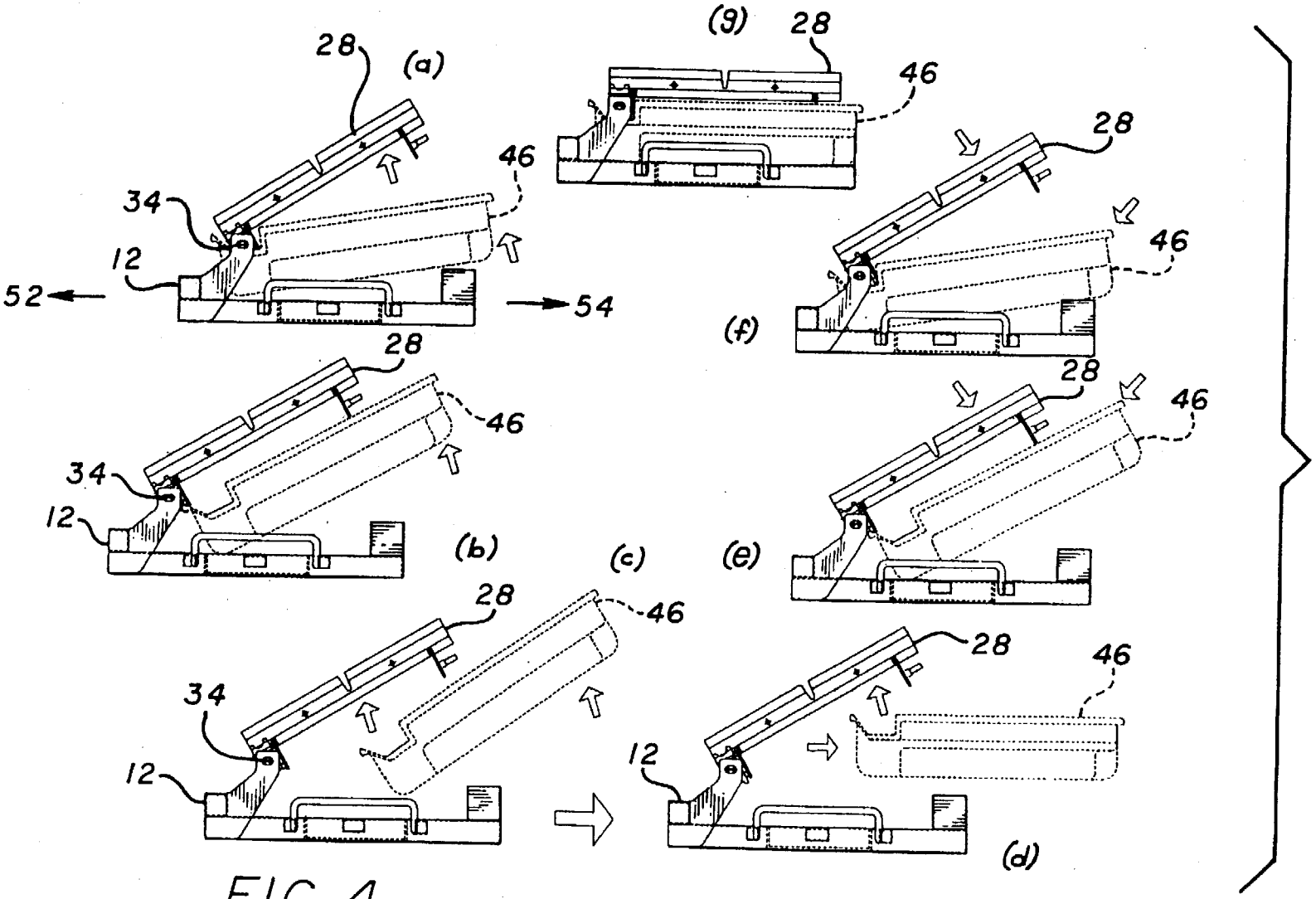
FIGS. 4(*a*)–4(*g*) are front elevational views of the cutting table and tray showing the pivoting action of the cutting table to provide clearance for removal of the tray.

FIG. 4 is a front elevational view of a preferred embodiment of the present invention cutting table 28 and tray 46. As seen in FIG. 4(*a*), the cutting table 28 is pivotably mounted to the rolling bar 34 which is in turn attached to the frame 12. As the sequence of events shown in FIGS. 4(*a*)–4(*g*) depicts, the cutting table 28 pivots on side 52 thereby lifting side 54 to allow the tray 56 to be removed from the frame 12. At the instant shown in FIG. 4(*d*), the tray 46 has completely cleared the frame 12. After the tray 46 is emptied, it is returned to its starting position underneath the cutting table as shown in FIG. 4(*e*). In FIG. 4(*g*), the cutting table 28 has been returned to its initial position overlying the tray 46. In this manner, the present invention provides a mechanism for easily and conveniently emptying the coolant tray 46 without disturbing the alignment of the work piece positioned on the cutting table 28 relative to the circular saw blade 22.

It is understood that various changes and modifications of the preferred embodiments described above are apparent to those skilled in the art. Such changes and modifications can be made without departing from the spirit and scope of the present invention. It is therefore intended that such changes and modifications are covered by the following claims.

What is claimed is:

1. A ceramic and masonry power saw comprising:

a cutting table attached to a frame;

a cutting head having a proximal end and a distal end, supported above the table and attached to the frame at a proximal end;

a motor attached to the cutting head;

a tapered bearing housing assembly disposed in the cutting head at the distal end;

a circular saw blade connected to the tapered bearing housing assembly;

a drive belt connected to the motor and the circular saw blade immediately adjacent thereto; and a tray disposed beneath the cutting table;

wherein the cutting table includes a hinge member connected to the frame, whereby the cutting table pivots around the frame.

2. The ceramic and masonry power saw of claim 1, wherein the cutting table includes a front, a back, a first side, and a second side opposite the first side so that the first side of the cutting table is hinged to the frame and permits the tray to be removable from the second side.

3. The ceramic and masonry power saw of claim 1, wherein the tapered bearing housing includes a steel material and the cutting head includes an aluminum material.

4. A ceramic and masonry power saw comprising:

a frame;

a cutting table having a front, a back, a first side, and a second side opposite the first side, wherein the table includes opposed rollers pinching the frame;

a cutting head extending above the table and attached to the frame;

a motor attached to the power saw;

a circular saw blade rotatably connected to the cutting head;

a drive belt interconnecting the motor to the circular saw blade; and a tray disposed on the frame beneath the cutting table, whereby the cutting table pivots on the first side away from the second side to permit removal of the tray away from the second side.

5. The ceramic and masonry power saw of claim 4, wherein the frame further comprises a cylindrical section and the rollers are disposed on opposite sides of the cylindrical section to roll therealong or to allowing the cutting table to pivot therearound.

6. The ceramic and masonry power saw of claim 4, wherein the motor includes an electric motor.

7. The ceramic and masonry power saw of claim 4, wherein the circular saw blade rotates on a shaft disposed in the cutting head, and the drive belt engages the shaft at a location immediately adjacent to the circular saw blade.

8. The ceramic and masonry power saw of claim 7, wherein the axle is rotatably supported within a tapered bearing housing disposed inside the cutting head, and wherein the tapered bearing housing includes a larger diameter oriented closer to the circular saw blade and a smaller diameter oriented farther away from the circular saw blade.

9. A ceramic and masonry power saw comprising:

a frame having a tubular section;

a table having a pair of oppositely disposed rollers pinching the tubular section of the frame, whereby the table pivots on the rollers against the tubular section;

a cutting head having a distal end and a proximal end, wherein the distal end extends over the table, and wherein the proximal end is attached to the frame;

a tapered bearing housing disposed inside the distal end of the cutting head;

a circular saw blade mounted on a shaft rotatably supported within the tapered bearing housing;

a motor attached to the saw;

a drive belt interconnecting the shaft to the motor, wherein the drive belt engages the shaft immediately adjacent to the circular saw blade; and a tray disposed beneath the table, whereby the cutting table pivots on a side and away from the tray on an opposite side to allow removal of the tray.

10. The ceramic and masonry power saw of claim 9, wherein the shaft includes a radial hole and the cutting head includes a radially biased locking pin passing through the cutting head and reversibly engaging the radial hole.

11. The ceramic and masonry power saw of claim 9, wherein the saw includes a blade cooling valve for supplying a coolant to the circular saw blade.

12. The ceramic and masonry power saw of claim 9, wherein the bearing housing includes a steel material.

13. The ceramic and masonry power saw of claim 9, wherein the cutting head includes an aluminum material.

14. The ceramic and masonry power saw of claim 9, wherein the circular saw blade is fastened to the shaft by a single nut threaded onto the shaft.

15. The ceramic and masonry power saw of claim 9, wherein each roller has a concave circumferential profile.

* * * * *